US010197952B2

(12) United States Patent
Mori

(10) Patent No.: US 10,197,952 B2
(45) Date of Patent: Feb. 5, 2019

(54) IMAGE FORMING APPARATUS, IMAGE FORMING SYSTEM AND IMAGE FORMING CONDITION CONTROLLING METHOD

(71) Applicant: Konica Minolta, Inc., Chiyoda-ku, Tokyo (JP)

(72) Inventor: Tomohide Mori, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/431,122

(22) Filed: Feb. 13, 2017

(65) Prior Publication Data

US 2017/0235256 A1 Aug. 17, 2017

(30) Foreign Application Priority Data

Feb. 15, 2016 (JP) ..... 2016-025998

(51) Int. Cl.
*G03G 15/16* (2006.01)

(52) U.S. Cl.
CPC ..... *G03G 15/1665* (2013.01)

(58) Field of Classification Search
CPC ..... G03G 15/164; G03G 15/1645; G03G 15/1655; G03G 15/1665; G03G 15/6517; G03G 2215/00223; G03G 2215/00227
See application file for complete search history.

(56) References Cited

U.S. PATENT DOCUMENTS 4,885,613 A * 12/1989 Kudoh ..... G03G 15/6517 271/9.03
4,969,016 A * 11/1990 Kudoh ..... G03G 15/6517 358/304
5,396,313 A * 3/1995 Zoltner ..... B65H 7/02 242/563
5,511,744 A * 4/1996 Abe ..... B65H 16/08 242/563
5,708,911 A * 1/1998 Kageyama ..... B65H 26/02 399/23
5,765,094 A * 6/1998 Nakamura ..... G03G 15/1655 399/298
5,768,675 A * 6/1998 Estabrooks ..... G03G 15/6517 101/224
2006/0062618 A1* 3/2006 Kobayashi ..... G03G 15/0131 399/384

(Continued)

FOREIGN PATENT DOCUMENTS

JP 2002091237 A * 3/2002
JP 2004069938 A 3/2004

(Continued)

OTHER PUBLICATIONS

Machine translation of JP2002091237.*

*Primary Examiner* — David Bolduc
(74) *Attorney, Agent, or Firm* — Cantor Colburn LLP

(57) ABSTRACT

An image forming apparatus includes: an image forming unit configured to form an image on a recording medium which is unwound from a state of being wound in a roll shape; and a control unit configured to change an image forming condition of the image forming unit such that image quality becomes uniform before and after an unwinding start position of the recording medium at the time of start of an image forming operation.

18 Claims, 12 Drawing Sheets

(56) References Cited

U.S. PATENT DOCUMENTS

| | | | | |
|---|---|---|---|---|
| 2011/0114691 | A1* | 5/2011 | Morinaga | B65H 16/005 226/102 |
| 2011/0211009 | A1* | 9/2011 | Fujinaga | B41J 29/393 347/16 |
| 2012/0020689 | A1* | 1/2012 | Inoue | G03G 15/238 399/68 |
| 2012/0251148 | A1* | 10/2012 | Moore | G03G 15/6517 399/66 |
| 2015/0316882 | A1* | 11/2015 | Hara | G03G 15/2085 399/323 |
| 2016/0259277 | A1* | 9/2016 | Umeno | G03G 15/2028 |
| 2016/0332836 | A1* | 11/2016 | Kanno | B65H 23/005 |
| 2017/0060042 | A1* | 3/2017 | Mori | G03G 15/1615 |

FOREIGN PATENT DOCUMENTS

| | | | |
|---|---|---|---|
| JP | 2005274892 | A | 10/2005 |
| JP | 2015055672 | A | 3/2015 |

* cited by examiner

IMAGE FORMING APPARATUS, IMAGE FORMING SYSTEM AND IMAGE FORMING CONDITION CONTROLLING METHOD

CROSS REFERENCE TO RELATED APPLICATIONS

The entire disclosure of Japanese Patent Application No. 2016-025998 filed on Feb. 15, 2016 including description, claims, drawings, and abstract are incorporated herein by reference in its entirety.

BACKGROUND OF THE INVENTION

Field of the Invention

The present invention relates to an image forming apparatus, an image forming system, and an image forming condition controlling method.

Description of the Related Art

Generally, an image forming apparatus (a printer, a copying machine, a facsimile, etc.) using an electrophotographic process technique forms an electrostatic latent image, by irradiating (exposing) a charged photoreceptor drum (image carrier) with a laser beam based on image data. Further, a toner is supplied from a developing device to the photoreceptor drum on which the electrostatic latent image has been formed, thereby visualizing the electrostatic latent image to form a toner image. Further, after the toner image is directly or indirectly transferred onto the sheet, the toner image is formed on the sheet by fixing the toner image through heating and pressurizing using a fixing nip.

Further, an image forming system, in which a sheet feeder which feeds continuous sheet (hereinafter, referred to as "long sheet") such as continuous roll sheet or folding sheet, and a sheet discharge device which stores the long sheet with the toner image formed by the image forming apparatus are connected at a preceding stage and a succeeding stage of the image forming apparatus respectively, has been put into practical use.

When the sheet is conveyed from a sheet feeding unit or the like, if each sheet in such an image forming apparatus, for example, is charged by rubbing, the transfer efficiency fluctuates at a transfer nip serving as a portion in which the toner image is transferred onto the sheet.

In order to solve this problem, for example, JP 2004-69938 A discloses a configuration in which the transfer condition for each part of a sheet is changed based on the surface potential of the sheet before entering the transfer nip.

Further, JP 2005-274892 A discloses a configuration in which a predetermined bias is applied to a conveyance belt that conveys a sheet to adjust the potential of the conveyance belt, thereby adjusting the potential of the sheet conveyed on the conveyance belt.

Meanwhile, in the image forming apparatus compatible with the long sheet, the long sheet is set in the apparatus before the start of the image forming operation. When the image forming operation is started, the long sheet is printed sequentially from apart which is set in the apparatus. FIG. 1 is an enlarged diagram showing a portion wound in a roll shape in the long sheet.

As shown in FIG. 1, when the image forming operation is started, a long sheet P is peeled off from an unwinding position Z, located on the most upstream side in the rotary direction, of a surface of a roll portion PP, which is a portion wound in a roll shape. At this time, when the long sheet P is peeled off, the surface of the roll portion PP is charged due to, for example, influence of static electricity or the like. In particular, in a film type medium such as a film tack sheet on which different materials are laminated, the sheet is in close contact with the roll portion PP. Therefore, charging due to peeling occurs remarkably. Meanwhile, in the case of a sheet type medium such as a commonly used cut sheet, such charging does not occur because the medium is not peeled off.

At the time of start of the image forming operation, a portion set in the apparatus and a preceding stage portion which is a downstream portion of the unwinding position Z in a rotary direction of the roll portion PP are not charged. For this reason, when a succeeding stage portion, which is an upstream portion of the unwinding position Z, is peeled off from the roll portion PP and charged after the start of the image forming operation, the surface potential of the long sheet differs between the preceding stage portion and the succeeding stage portion. Accordingly, when printing is performed under the same image forming condition, there is a problem of changes in image quality between the preceding stage portion and the succeeding stage portion.

FIG. 2 is a diagram showing changes in the surface potential of the long sheet with respect to the peeling rate at which the long sheet is peeled off from the roll portion. For example, as shown in FIG. 2, because it is empirically known that the intensity of charging generated by peeling of the long sheet and the roll portion, that is, the magnitude of the surface potential depends on the peeling rate, the surface potential of the long sheet increases as the peeling rate increases. In addition, when the long sheet is unwound from the roll portion, it always moves away from the roll portion at a tangent angle or more. Thus, as the long sheet is unwound, the roll portion becomes smaller in diameter, and the peeling rate increases.

For this reason, at the time of continuous image forming operation, when the transfer on the long sheet is hindered by an increase in the surface potential of the long sheet due to an increase in peeling rate, the transfer efficiency decreases, and therefore, the image density of the succeeding stage portion of the long sheet becomes lower than that of the preceding stage portion.

Furthermore, when the long sheet is charged, in the halftone image formed of dots, the dot portions are scattered around or attracted to each other. As a result, image failure due to collapse of the dot shape occurs. For this reason, the density of the image varies between the preceding stage portion and the succeeding stage portion of the roll portion, and furthermore, when continuous printing is performed, a large difference occurs in the density between the image of the preceding stage portion of the long sheet and the image of the succeeding stage portion of the long sheet.

Further, in the case of a film tack sheet, due to the charging caused by a combination of different materials as well as the sheets having a smooth surface coming into close contact with each other at the portion of the roll portion, the amount of charge due to peeling further increases. Further, when overprinting is performed, charging is performed by transfer in base printing. As a result, the amount of charge on the surface of the long sheet becomes larger than that of the long sheet which is not subjected to overprinting. Further, the charged state also varies depending on the density of the image subjected to the base printing. Even in such a case, due to the influence of charging caused by peeling of the long sheet, a difference in image quality occurs between the preceding stage portion and the succeeding stage portion of the long sheet.

Further, the configurations described in JP 2004-69938 A and JP 2005-274892 A are techniques for solving a problem caused by frictional charging on sheets such as a cut sheet. Therefore, such techniques are not sufficient as a countermeasure against charging caused by peeling of a long sheet wound in a roll shape, and cannot solve the problem of charging caused by peeling.

SUMMARY OF THE INVENTION

An object of the present invention is to provide an image forming apparatus, an image forming system, and an image forming condition controlling method capable of making an image quality of a recording medium wound in a roll shape uniform.

To achieve the abovementioned object, according to an aspect, an image forming apparatus reflecting one aspect of the present invention comprises: an image forming unit configured to form an image on a recording medium which is unwound from a state of being wound in a roll shape; and a control unit configured to change an image forming condition of the image forming unit such that image quality becomes uniform before and after an unwinding start position of the recording medium at the time of start of an image forming operation.

To achieve the abovementioned object, according to an aspect, an image forming system including a plurality of units including an image forming apparatus, reflecting one aspect of the present invention comprises: an image forming unit configured to form an image on a recording medium which is unwound from a state of being wound in a roll shape; and a control unit configured to change an image forming condition of the image forming unit such that image quality becomes uniform before and after an unwinding start position of the recording medium at the time of start of an image forming operation.

To achieve the abovementioned object, according to an aspect, an image forming condition controlling method reflecting one aspect of the present invention comprises: changing an image forming condition which is set for forming an image such that image quality becomes uniform before and after an unwinding start position of a recording medium at the time of start of an image forming operation, when forming the image on the recording medium which is unwound from a state of being wound in a roll shape.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 3:
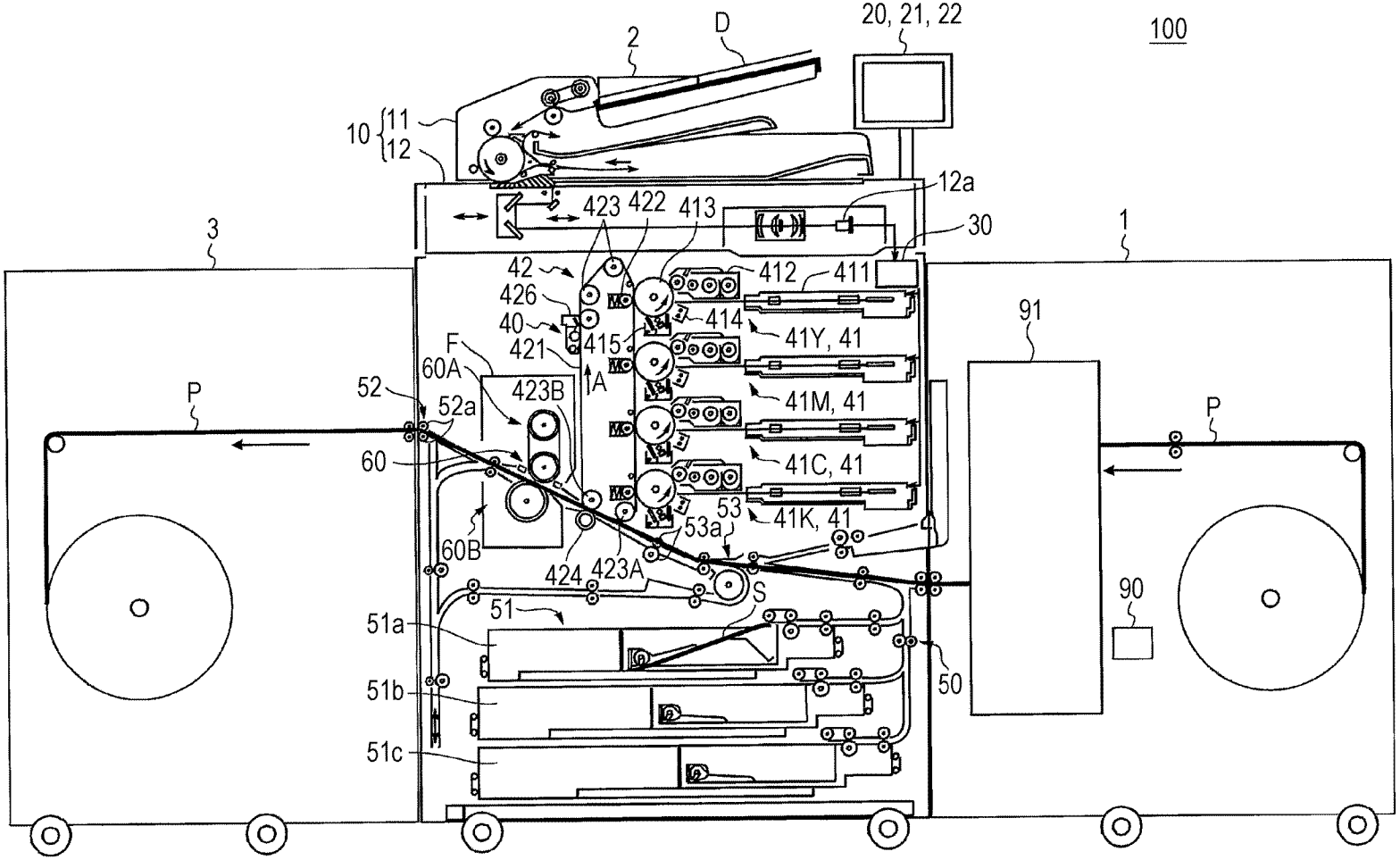
FIG. 3 is a diagram schematically showing an overall configuration of an image forming system according to an embodiment of the present invention.
Figure 4:
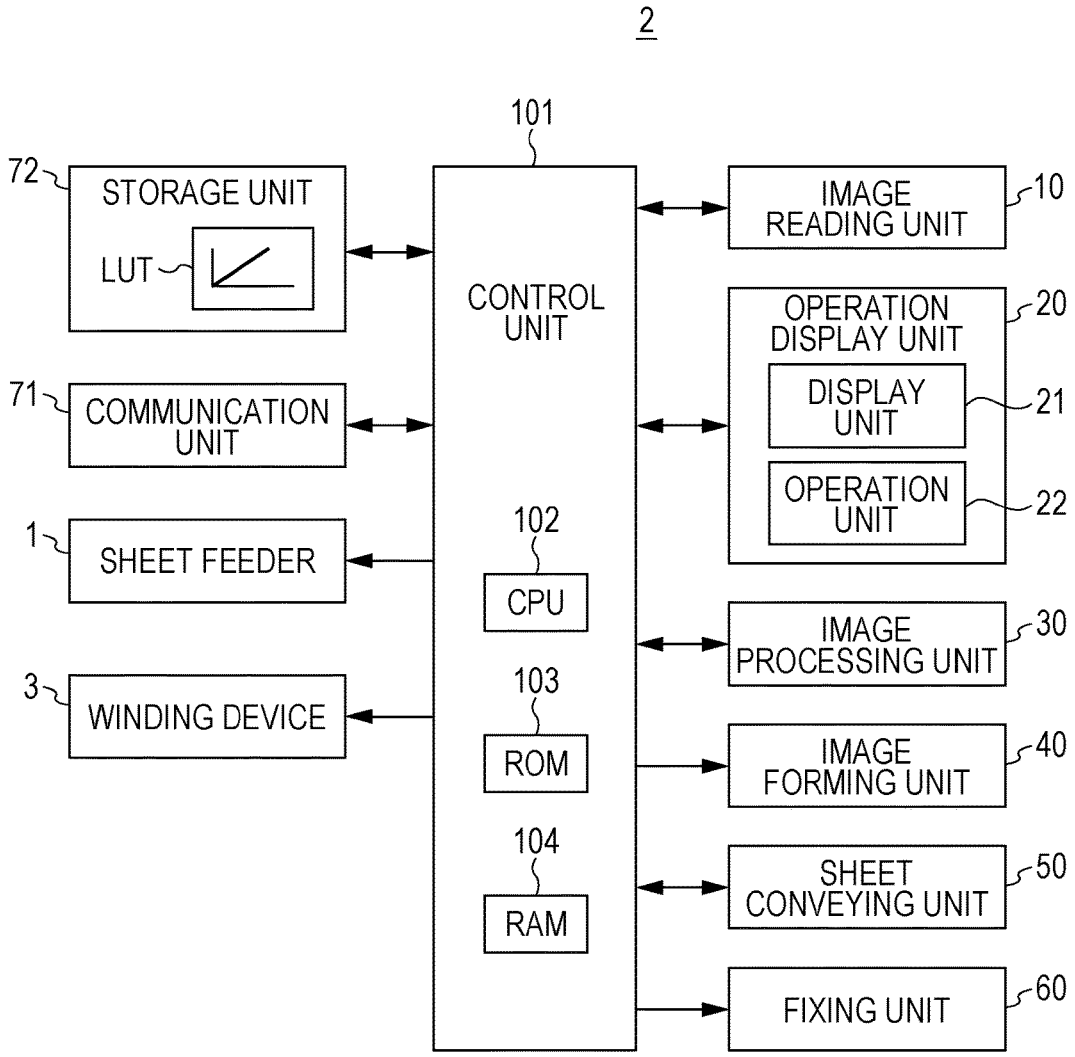
FIG. 4 is a diagram showing a main part of a control system of an image forming apparatus included in the image forming system according to an embodiment of the present invention.

Hereinafter, an embodiment of the present invention will be described in detail with reference to the drawings. However, the scope of the invention is not limited to the illustrated examples. FIG. 3 is a diagram schematically showing an overall configuration of an image forming system 100 according to the present embodiment. FIG. 4 is a diagram showing a main part of a control system of an image forming apparatus 2 included in the image forming system 100 according to the present embodiment.

The image forming system 100 forms an image on a long sheet P or a sheet S (non-long sheet) using the long sheet P or the sheet S indicated by a bold line in FIG. 3 as a recording medium.

The long sheet P is, for example, a long sheet having a length exceeding the main body width of the image forming apparatus 2 in its conveying direction, and includes a roll sheet and a continuous sheet. The long sheet P corresponds to the "recording medium" of the present invention.

As shown in FIG. 3, the image forming system 100 is configured by connecting a sheet feeder 1, the image forming apparatus 2, and a winding device 3 from the upstream side along the conveying direction of the long sheet P. The sheet feeder 1 and the winding device 3 are used when forming an image on the long sheet P.

The sheet feeder 1 is a device which feeds the long sheet P to the image forming apparatus 2. As shown in FIG. 3, inside the housing of the sheet feeder 1, the long sheet P is wound around a support shaft in a roll shape and is held to be rotatable. The sheet feeder 1 conveys the long sheet P wound around the support shaft to the image forming apparatus 2 at a constant speed, for example, via a plurality of conveying roller pairs such as a delivery roller and a sheet feed roller. The feeding operation of the sheet feeder 1 is controlled by a control unit 101 provided in the image forming apparatus 2.

The sheet feeder 1 is provided with an outer diameter detecting unit 90 for detecting an outer diameter of the roll portion which is a portion of the long sheet P wound in a roll shape. The outer diameter detecting unit 90 is, for example, a sensor which measures the vertical distance of the roll portion, and detects the outer diameter of the roll portion and outputs the outer diameter information to the control unit 101.

Further, a buffer unit 91 for retaining the conveyed long sheet P is provided on the downstream side of the roll portion in the sheet feeder 1. Thus, for example, when the unwinding rate of the long sheet P from the roll portion is slower than the conveying rate of the long sheet P in the image forming apparatus 2, by retaining the long sheet P in the buffer unit 91 in advance, it is possible to absorb the difference in speed of the long sheet P between the sheet feeder 1 and the image forming apparatus 2.

The image forming apparatus 2 is an intermediate transfer type color image forming apparatus that utilizes an electrophotographic process technique. That is, the image forming apparatus 2 primarily transfers toner images of respective colors of Y (yellow), M (magenta), C (cyan), and K (black) formed on a photoreceptor drum 413 to an intermediate transfer belt 421, superimposes the toner images of four colors on the intermediate transfer belt 421, and thereafter, secondarily transfers the toner images onto the long sheet P fed from the sheet feeder 1 or the sheet S sent from sheet feeding tray units 51*a* to 51*c*, thereby forming an image.

Further, in the image forming apparatus 2, a tandem system is adopted in which the photoreceptor drums 413 corresponding to four colors of Y, M, C, and K are arranged in series in a running direction of the intermediate transfer belt 421, and the respective color toner images are sequentially transferred onto the intermediate transfer belt 421 in a single procedure.

As shown in FIG. 4, the image forming apparatus 2 includes an image reading unit 10, an operation display unit 20, an image processing unit 30, an image forming unit 40, a sheet conveying unit 50, a fixing unit 60, and a control unit 101.

The control unit 101 includes a central processing unit (CPU) 102, a read only memory (ROM) 103, a random access memory (RAM) 104 and the like. The CPU 102 reads a program corresponding to the processing contents from the ROM 103, develops the program in the RAM 104, and cooperates with the developed program to centrally control the operation of each block and the like of the image forming apparatus 2. At this time, various data stored in the storage unit 72 are referred to. The storage unit 72 includes, for example, a nonvolatile semiconductor memory (so-called flash memory) or a hard disk drive.

The control unit 101 transmits/receives various data to/from an external device (for example, a personal computer) connected to a communication network such as a local area network (LAN) and a wide area network (WAN) via the communication unit 71. The control unit 101 receives, for example, image data (input image data) transmitted from an external device, and forms an image on the long sheet P or the sheet S based on the image data. The communication unit 71 includes, for example, a communication control card such as a LAN card.

As shown in FIG. 3, the image reading unit 10 includes an automatic document feeder 11 (ADF), a document image scanner 12 (scanner), and the like.

The automatic document feeder 11 conveys the document D placed on a document tray by a conveying mechanism and sends the document to the document image scanner 12. It is possible for the automatic document feeder 11 to continuously read images (including both sides) of a large number of documents D placed on the document tray at once.

The document image scanner 12 optically scans a document conveyed onto the contact glass from the automatic document feeder 11 or a document placed on the contact glass, forms an image of light reflected from the document on a light-receiving surface of a charge coupled device (CCD) sensor 12*a*, and reads the document image. The image reading unit 10 generates input image data based on a reading result provided by the document image scanner 12. The input image data is subjected to predetermined image processing in the image processing unit 30.

As shown in FIG. 4, the operation display unit 20 includes, for example, a liquid crystal display (LCD) with a touch panel, and functions as the display unit 21 and the operation unit 22. The display unit 21 displays various operation screens, image states, operation states of the respective functions and the like in accordance with the display control signal input from the control unit 101. The operation unit 22 includes various operation keys such as ten keys and a start key, accepts various input operations of the user, and outputs the operation signal to the control unit 101.

The image processing unit 30 includes a circuit or the like which performs digital image processing depending on the initial setting or user setting on the input image data. For example, under the control of the control unit 101, the image processing unit 30 performs tone correction based on tone correction data (tone correction table). In addition to the tone correction, the image processing unit 30 performs various correction processing such as color correction and shading correction, compression processing and the like on the input image data. The image forming unit 40 is controlled based on the image data subjected to the processing.

As shown in FIG. 3, the image forming unit 40 includes image forming units 41Y, 41M, 41C and 41K for forming images of each color toner of Y component, M component, C component and K component based on input image data, an intermediate transfer unit 42, and the like. The intermediate transfer unit 42 corresponds to the "transfer unit" of the present invention.

Figure 1:
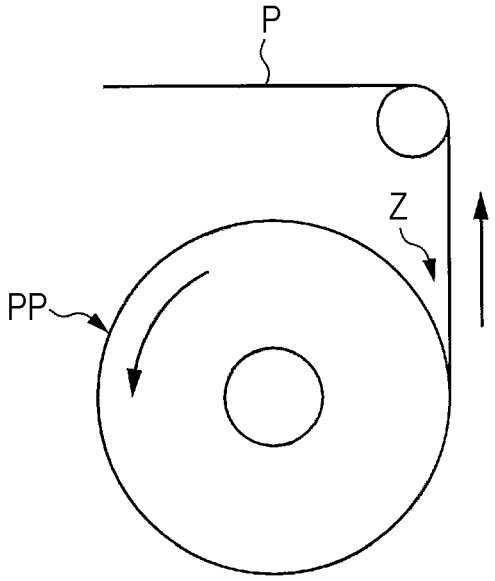
FIG. 1 is an enlarged diagram showing a portion wound in a roll shape on a long sheet.

The image forming units 41Y, 41M, 41C, and 41K for Y component, M component, C component and K component have the same configuration. For convenience of illustration and explanation, common constituent elements are denoted by the same reference numerals, and when differentiating them, symbols Y, M, C, or K are added to the reference numerals. In FIG. 1, only the constituent elements of the image forming unit 41Y for the Y component are denoted by reference numerals, and the reference numerals of the constituent elements of the other image forming units 41M, 41C and 41K are omitted.

The image forming unit 41 includes an exposure device 411, a developing device 412, a photoreceptor drum 413, a charging device 414, a drum cleaning device 415, and the like.

The photoreceptor drum 413 includes, for example, an organic photoreceptor having a photosensitive layer made of a resin containing an organic photoconductor formed on an outer peripheral surface of a drum-shaped metal base.

The control unit 101 controls the drive current supplied to a drive motor (not shown) that rotates the photoreceptor drum 413, thereby rotating the photoreceptor drum 413 at a constant circumferential speed.

The charging device 414 is, for example, an electrification charger, and generates a corona discharge to uniformly charge the surface of the photoconductive photoreceptor drum 413 to have a negative polarity.

The exposure device 411 includes, for example, a semiconductor laser, and irradiates the photoreceptor drum 413 with a laser beam corresponding to an image of each color component. As a result, an electrostatic latent image of each color component is formed in the image region irradiated with the laser beam on the surface of the photoreceptor drum 413, due to the potential difference from the background region.

The developing device 412 is a two-component reversal type developing device, and visualizes the electrostatic latent image by attaching the developer of each color component to the surface of the photoreceptor drum 413 to form a toner image.

To the developing device 412, for example, a DC developing bias having the same polarity as the charging polarity of the charging device 414 or a developing bias in which a DC voltage of the same polarity as the charging polarity of the charging device 414 is superimposed on the AC voltage is applied. As a result, reversal development for attaching toner to the electrostatic latent image formed by the exposure device 411 is performed.

The drum cleaning device 415 has a flat plate-shaped drum cleaning blade or the like made of an elastic body that comes into contact with the surface of the photoreceptor drum 413, and removes the toner which remains on the surface of the photoreceptor drum 413 without being transferred to the intermediate transfer belt 421.

The intermediate transfer unit 42 includes an intermediate transfer belt 421, a primary transfer roller 422, a plurality of support rollers 423, a secondary transfer roller 424, a belt cleaning device 426, and the like.

The intermediate transfer belt 421 includes an endless belt, and is stretched around the plurality of support rollers 423 in a loop shape. At least one of the plurality of support rollers 423 includes a driving roller, and others include a driven roller. For example, a roller 423A arranged on the downstream side of the primary transfer roller 422 for the K component in the belt running direction is preferably a driving roller. This makes it easier to keep the running speed of the belt at the primary transfer portion constant. As the driving roller 423A rotates, the intermediate transfer belt 421 runs in the direction of the arrow A at a constant speed.

The intermediate transfer belt 421 is a belt having conductivity and elasticity, and has a high resistance layer on its surface. The intermediate transfer belt 421 is rotationally driven by a control signal from the control unit 101.

The primary transfer roller 422 is disposed on the inner peripheral surface side of the intermediate transfer belt 421 so as to face the photoreceptor drum 413 of each color component. A primary transfer nip for transferring a toner image from the photoreceptor drum 413 to the intermediate transfer belt 421 is formed, by pressing the primary transfer roller 422 against the photoreceptor drum 413 with the intermediate transfer belt 421 interposed between the primary transfer roller 422 and the photoreceptor drum 413.

A secondary transfer roller 424 is disposed on the outer peripheral surface side of the intermediate transfer belt 421 so as to face a backup roller 423B disposed on the downstream side in the belt running direction of the driving roller 423A. A secondary transfer nip for transferring the toner image from the intermediate transfer belt 421 to the long sheet P or the sheet S is formed, by pressing the secondary transfer roller 424 against the backup roller 423B with the intermediate transfer belt 421 interposed between the secondary transfer roller 424 and the backup roller 423B.

When the intermediate transfer belt 421 passes through the primary transfer nip, the toner images on the photoreceptor drum 413 are sequentially superimposed on and primarily transferred onto the intermediate transfer belt 421. Specifically, by applying a primary transfer bias to the primary transfer roller 422 and by imparting a charge having an opposite polarity of the toner to the back side of the intermediate transfer belt 421, that is, the side coming into contact with the primary transfer roller 422, the toner image is electrostatically transferred to the intermediate transfer belt 421.

Thereafter, when the long sheet P or the sheet S passes through the secondary transfer nip, the toner image on the intermediate transfer belt 421 is secondarily transferred onto the long sheet P or the sheet S. Specifically, by applying a secondary transfer bias to the secondary transfer roller 424, and by imparting charge of an opposite polarity of the toner to the back side of the long sheet P or the sheet S, that is, the side coming into contact with the secondary transfer roller 424, the toner image is electrostatically transferred onto the long sheet P or the sheet S. The long sheet P or the sheet S onto which the toner image has been transferred is conveyed toward the fixing unit 60.

The belt cleaning device 426 removes the transfer residual toner remaining on the surface of the intermediate transfer belt 421 after the secondary transfer. In place of the secondary transfer roller 424, a so-called belt-type secondary transfer unit having a configuration in which the secondary transfer belt is stretched in a loop shape around a plurality of support rollers including the secondary transfer roller may also be adopted.

The fixing unit 60 includes an upper fixing unit 60A having a fixing surface side member arranged on the fixing surface of the long sheet P or the sheet S, that is, on the surface side on which the toner image is formed, a lower fixing unit 60B having a back side support member arranged on the back of the long sheet P or the sheet S, that is, on the surface side opposite to the fixing surface, a heating source (not shown) and the like. By pressing the back side support member against the fixing surface side member, a fixing nip for holding and conveying the long sheet P or the sheet S is formed.

The fixing unit 60 fixes the toner image to the long sheet P or the sheet S, by heating and pressing the conveyed long sheet P or sheet S onto which the toner image has been secondarily transferred, using the fixing nip. The fixing unit 60 is disposed as a unit in the fixing device F. Further, an air separation unit for separating the long sheet P or the sheet S from the fixing surface side member or the back side support member by blowing air may be disposed on the fixing device F.

The sheet conveying unit 50 includes a sheet feeding unit 51, a sheet discharging unit 52, a conveying route unit 53, and the like. In the three sheet feeding tray units 51*a* to 51*c* constituting the sheet feeding unit 51, a sheet S (standard long sheet, and special long sheet) identified based on basis weight, size and the like is stored for each preset type. The conveying route unit 53 has a plurality of conveying roller pairs including a registration roller pair 53*a*. A registration roller portion in which the registration roller pair 53*a* is disposed corrects the inclination and deviation of the sheet S or the long sheet P.

Sheets S stored in the sheet feeding tray units 51*a* to 51*c* are sent one by one from the uppermost portion and are conveyed to the image forming unit 40 by the conveying route unit 53. In the image forming unit 40, the toner images of the intermediate transfer belt 421 are collectively and secondarily transferred onto one side of the sheet S, and the fixing process is performed in the fixing unit 60.

Further, the long sheet P fed from the sheet feeder 1 to the image forming apparatus 2 is conveyed to the image forming unit 40 by the conveying route unit 53. Further, in the image forming unit 40, the toner images of the intermediate transfer belt 421 are collectively and secondarily transferred onto one side of the long sheet P, and the fixing process is performed in the fixing unit 60. The long sheet P or the sheet S on which the image has been formed is conveyed to the winding device 3 by a sheet discharging unit 52 including a conveying roller pair (sheet discharging roller pair) 52*a*.

The winding device 3 is a device which winds the long sheet P conveyed from the image forming apparatus 2. In the casing of the winding device 3, for example, the long sheet P is wound around the support shaft and held in a roll shape. For this purpose, the winding device 3 rolls the long sheet P conveyed from the image forming apparatus 2 around the support shaft at a constant speed via a plurality of conveying roller pairs (for example, a delivery roller and a sheet discharging roller). The winding operation of the winding device 3 is controlled by the control unit 101 provided in the image forming apparatus 2.

Figure 5:
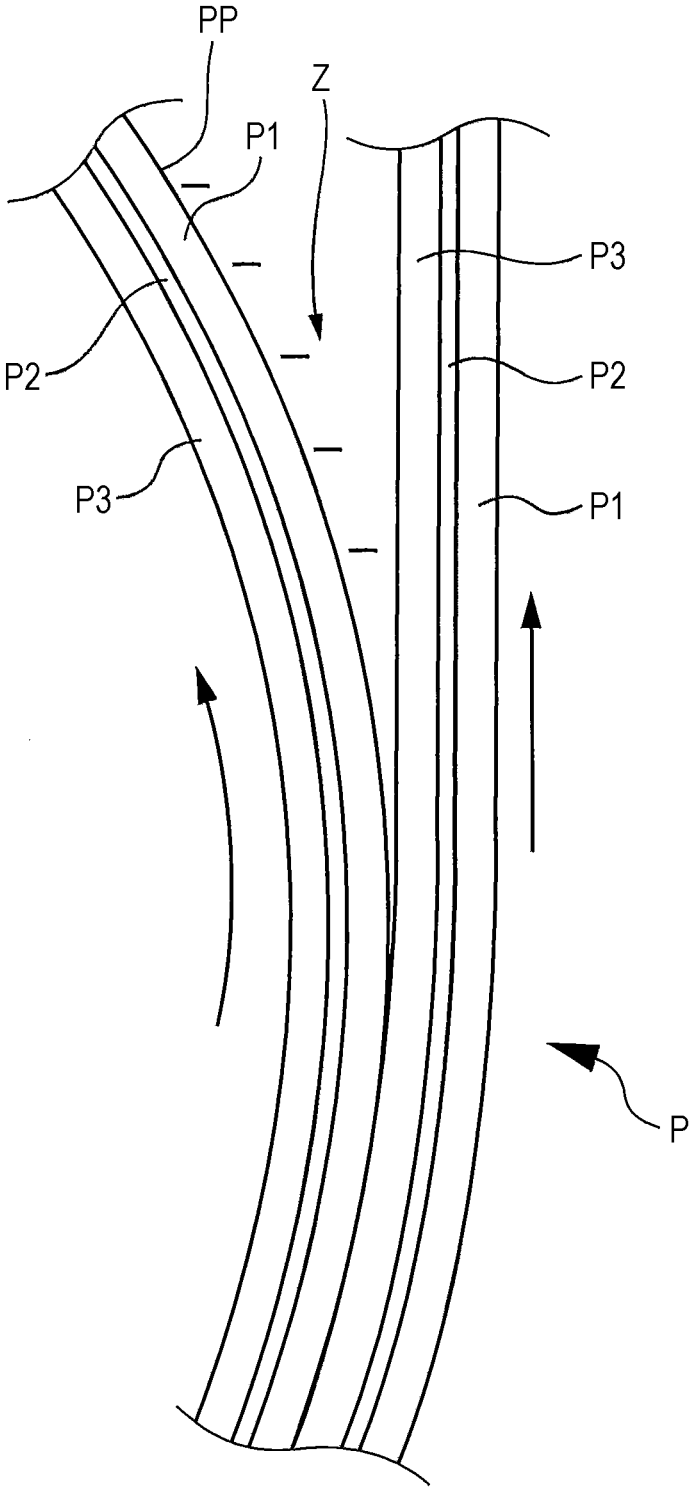
FIG. 5 is an enlarged view of an unwinding position of the roll portion.

As shown in FIG. 5, the long sheet P in the present embodiment is a tack sheet including three layers made of different materials, and has a surface layer P1, an adhesive layer P2, and a peeling layer P3.

The surface layer P1 is a portion in which an image is formed, and is made of, for example, paper, polypropylene (PP), polyethylene terephthalate (PET), polyethylene (PE), polyvinyl chloride (PVC) or the like. The adhesive layer P2 is an adhesive portion and is made of an acrylic adhesive material, a rubber type adhesive material or the like.

The peeling layer P3 is a portion which is peeled off from the adhesive layer P2, and is made of glassine paper, kraft paper, high quality paper, PET film or the like. In order to enhance releasability from the adhesive layer P2, a material obtained by applying silicon coating or PE lamination to the surface of the peeling layer P3 is generally used.

By the way, the long sheet P is peeled off from the unwinding position Z of the roll portion PP by the start of the unwinding operation at the start of the image forming operation. At this time, the surface of the roll portion PP is charged by the influence of static electricity or the like generated by peeling of the long sheet P. Specifically, when the peeling layer P3 of the long sheet P to be unwound and the surface layer P1 of the roll portion PP are peeled off, a portion of the unwinding position Z of the surface layer P1 of the roll portion PP is charged to, for example, negative polarity.

In such charging, when the long sheet P includes the film type surface layer P1 and the peeling layer P3 made of a PET film as in this embodiment, because the surfaces of the surface layer P1 and the peeling layer P3 are both smooth, both layers are particularly strongly charged during peeling. Besides the tack sheet, even the sheet having the surface subjected to lamination processing such as of polypropylene or PET is also likely to be charged by peeling.

The unwinding position Z at the start of the image forming operation, that is, the surface of the long sheet P after the unwinding start position is charged by repetition of peeling. However, at the start of the image forming operation, the portion set in the apparatus and the preceding stage portion which is a portion on the downstream side of the unwinding start position in the rotary direction of the roll portion PP are not charged. Therefore, the surface potential of the long sheet P differs between the preceding stage portion and the succeeding stage portion. Therefore, when printing is performed under the same image forming condition, there is a problem of changes in the image quality between the preceding stage portion and the succeeding stage portion.

Figure 6:
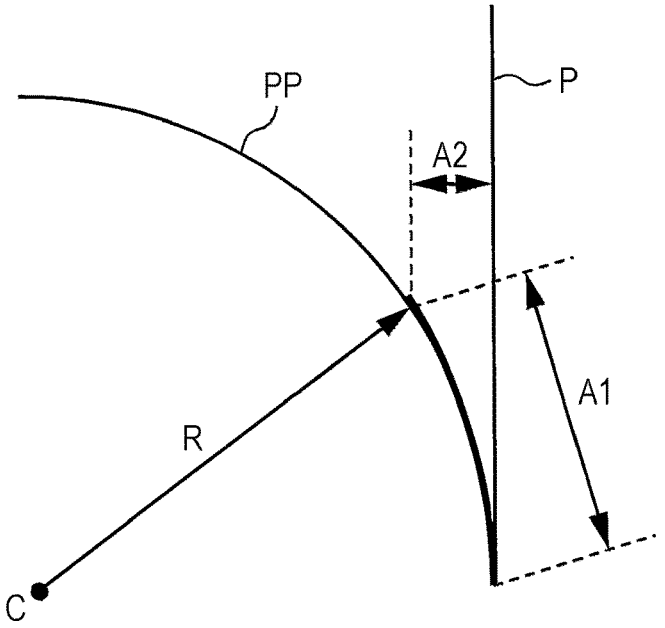
FIG. 6 is a diagram showing an unwinding position portion of the roll portion.
Figure 7:
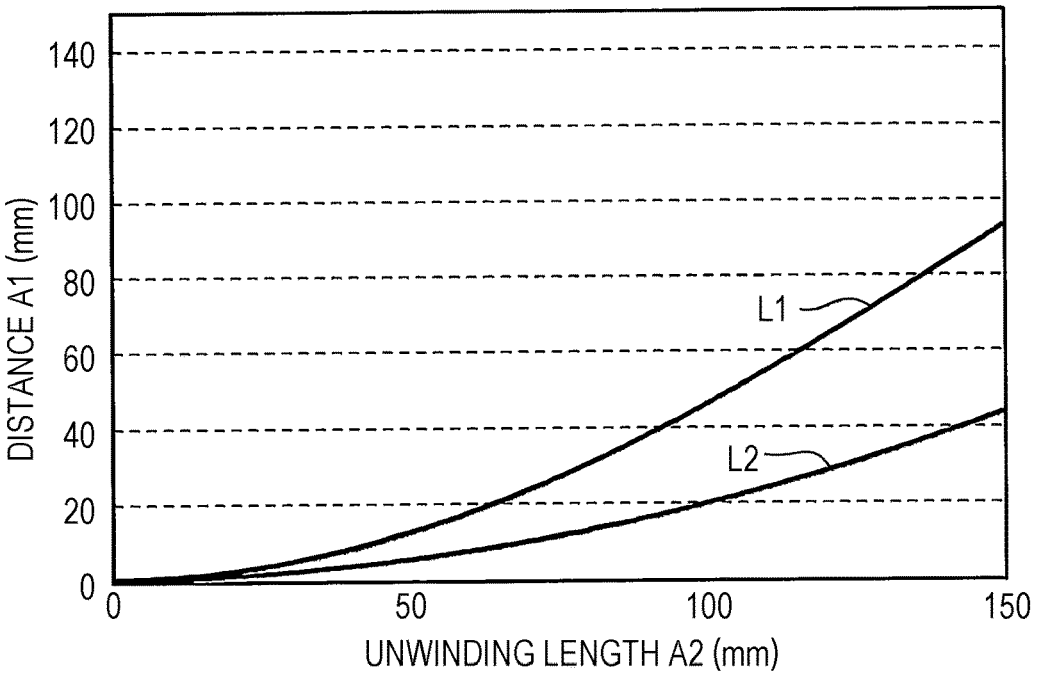
FIG. 7 is a diagram showing a relationship between the unwinding length and the distance.
Figure 8:
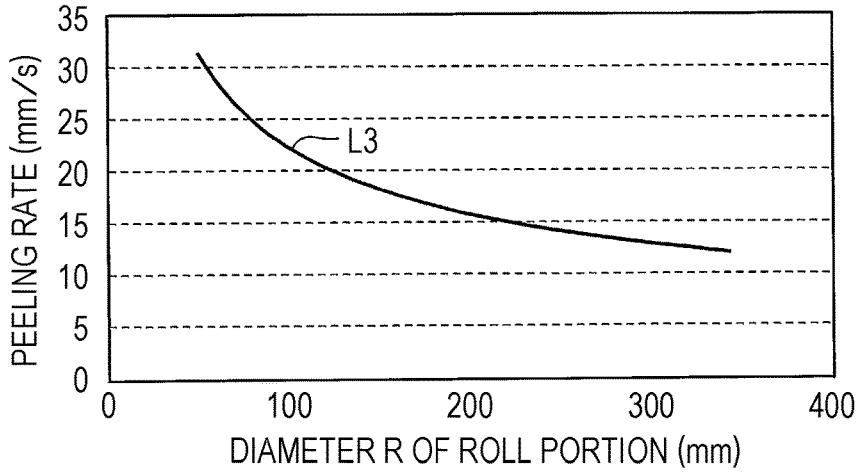
FIG. 8 is a diagram showing a relationship between the peeling rate and the radius of the roll portion when the distance to the unwinding length is 1 mm.

Further, the surface potential of the long sheet P fluctuates by fluctuation of the peeling rate at which the long sheet P is peeled off from the roll portion PP (see FIG. 2), which will be described in detail. FIG. 6 is a diagram showing the unwinding position portion of the roll portion PP, FIG. 7 is a diagram showing a relationship of a distance between the roll portion and the long sheet with respect to the unwinding length of the long sheet, and FIG. 8 is a diagram showing a relationship of the peeling rate relative to the radius of the roll portion when the distance to the unwinding length is 1 mm. In FIG. 7, a curve L1 shows a case where the radius R of the roll portion PP is 100 mm, and a curve L2 shows a case where the radius R of the roll portion PP is 250 mm.

As shown in FIG. 6, when the radius of the roll portion PP is set as R, and the distance from the position where the length from the unwinding position on the roll portion PP is A1 to the long sheet P is set as A2, a relationship among the length A1, the distance A2 and the radius R when the long sheet P is unwound by the length A1 from the start of unwinding is represented by the following Formula (1):

$$A2=R-R\times\cos(180\times A1/(\pi\times R)) \quad (1)$$

According to the above Formula (1), a relationship as shown in FIG. 7 is obtained. That is, the distance A2 between the long sheet P and the roll portion PP is larger in the curve L1 having a smaller diameter of the roll portion PP than in the curve L2 having a larger diameter of the roll portion PP. In other words, it is possible to confirm that, as the diameter of the roll portion PP decreases, the long sheet P is quickly separated from the roll portion PP.

Therefore, as shown in FIG. 8, for example, the peeling rate of the long sheet P with respect to the roll portion PP at a position where the distance A2 is 1 mm increases as the diameter of the roll portion PP decreases (see a curve L3). In this way, from the relationship of FIGS. 2, 7 and 8, as the long sheet P is unwound from the roll portion PP and the diameter of the roll portion PP decreases, the charge amount provided by peeling increases.

Figure 9:
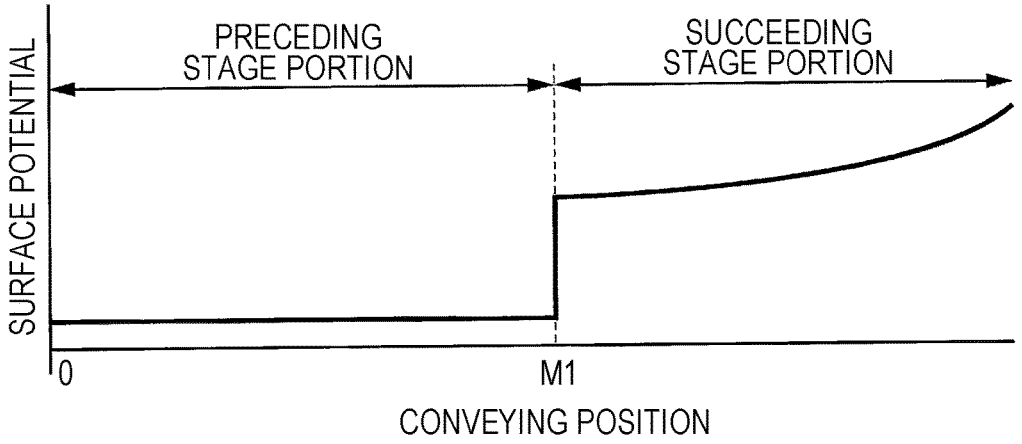
FIG. 9 is a diagram showing a change in surface potential of the long sheet with respect to a conveying position of the long sheet.

FIG. 9 is a diagram showing a change in the surface potential of the long sheet P with respect to the position in the conveying direction of the long sheet P (hereinafter, simply referred to as "conveying position"). "0" on the horizontal axis in and after FIG. 9 indicates the conveying position located at the transfer nip at the start of the image forming operation of the long sheet P, and "M1" indicates the conveying position located at the unwinding start position of the roll portion PP. Further, the conveying position M1 of the long sheet P is separated from the conveying position 0 by, for example, about 500 cm.

From these, as shown in FIG. 9, the surface potential of the long sheet P rapidly rises from the preceding stage portion of the surface potential of the conveying position M1 located at the unwinding start position. Further, because the roll portion PP decreases in diameter by being unwound, the surface potential of the portion after the conveying position M1 gradually increases.

As a result, the image quality changes between the preceding stage portion and the succeeding stage portion of the unwinding start position of the roll portion PP. As the image forming operation proceeds, the surface potential of the long sheet P increases. Accordingly, the image density decreases toward the latter stage in the image forming operation.

Figure 10:
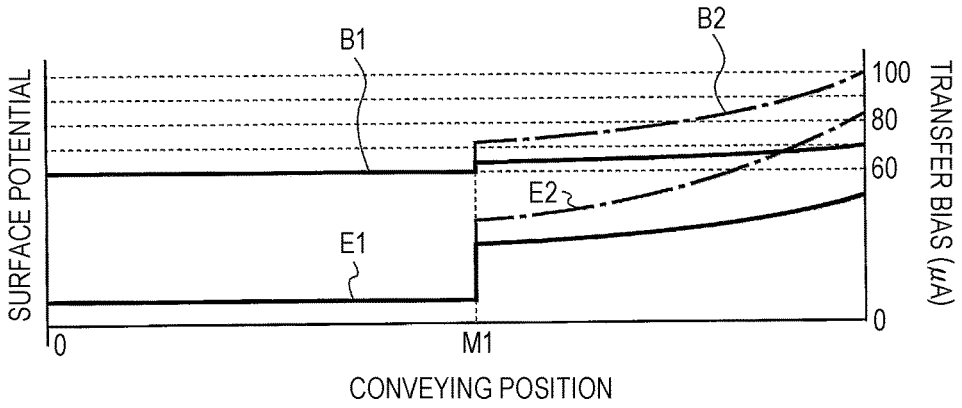
FIG. 10 is a diagram showing a surface potential and a transfer bias of the long sheet with respect to a conveying position of the long sheet.

Therefore, in this embodiment, as shown in FIG. 10, the control unit 101 changes the transfer condition as the image forming condition, specifically, the secondary transfer bias (hereinafter, simply referred to as "transfer bias") such that the image quality is uniform before and after the unwinding start position of the roll portion PP.

A solid line E1 in FIG. 10 indicates the surface potential when the roll portion PP has a large diameter (for example, the radius of the roll portion PP is 250 mm) at the time of start of printing, and an alternate long and short dashed line E2 shows the surface potential when the roll portion PP has a small diameter (for example, the radius of the roll portion PP is 80 mm) at the time of start of printing. Further, a solid line B1 indicates a transfer bias when the roll portion PP has a large diameter at the time of start of printing, and an alternate long and short dashed line B2 indicates a transfer bias when the roll portion PP has a small diameter at the time of start of printing.

Specifically, the control unit 101 changes the absolute value of the transfer bias before and after the unwinding start position of the roll portion PP to be made greater than the portion in which the long sheet P is not charged, that is, the front portion of the conveying position M1 (see the solid line B1 and the alternate long and short dashed line B2). Further, the control unit 101 gradually increases the absolute value of the transfer bias after the unwinding start position of the roll portion PP, that is, as the diameter of the roll portion PP decreases by unwinding the long sheet P from the roll portion PP.

As a result, because the transfer bias corresponding to the changes in the surface potential of the long sheet P (see the solid line E1 and the alternate long and short dashed line E2) is applied to the secondary transfer nip (hereinafter, also simply referred to as "transfer nip") after the unwinding start position, it is possible to suppress occurrence of image failure in the portion after the unwinding start position of the long sheet P. Further, it is possible to suppress a decrease in the image density at the latter stage in the image forming operation with the progress of the image forming operation.

Further, the control unit 101 determines an amount of change in the transfer bias depending on the diameter of the roll portion PP. Specifically, the control unit 101 sets the amount of change in the transfer bias to be greater in the case of the small diameter of the roll portion PP (alternate long and short dashed line B2) than in the case of the large diameter (solid line B1).

The surface potential of the long sheet P increases when the long sheet is consecutively printed, but the surface potential decreases by the discharge when printing is stopped. For example, when printing is stopped after the roll portion PP decreases in diameter with the progress of the image forming operation and printing is resumed after the surface potential is discharged, in the surface potential after the unwinding start position, the surface potential (alternate long and short dashed line E2) at the time of the small-diameter roll portion PP is greater than the surface potential (solid line E1) at the time of the large diameter.

Therefore, when the amount of change in the transfer bias is made constant irrespective of the diameter of the roll portion PP, there is a possibility that the transfer bias suitable for the surface potential of the long sheet P may not be obtained. However, in the present embodiment, because the amount of change in the transfer bias is changed depending on the diameter of the roll portion PP, it is possible to set the transfer bias suitable for the surface potential of the long sheet P depending on the diameter of the roll portion PP.

Here, an example of the setting of the transfer bias depending on the diameter of the roll portion PP will be described in detail with reference to the example shown in FIG. 11.

Figure 11:
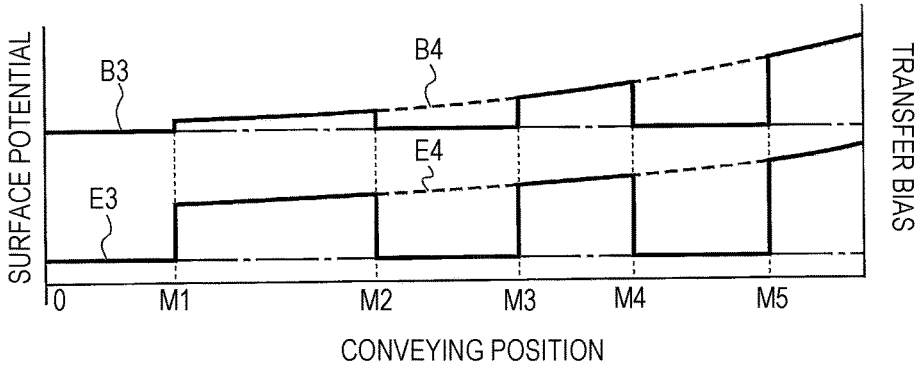
FIG. 11 is a diagram showing the surface potential and the transfer bias of the long sheet with respect to the conveying position of the long sheet in the case of intermittent printing and continuous printing.

FIG. 11 is a diagram showing a relationship between a surface potential and a transfer bias with respect to a conveying position when intermittent printing and continuous printing are performed. "M2" on the horizontal axis in FIG. 11 indicates a conveying position at the time of stopping the first image forming operation in the intermittent printing, "M4" indicates a conveying position at the time of stopping the second image forming operation in the intermittent printing, "M3" indicates a conveying position corresponding to the unwinding start position at the time of starting the second image forming operation in the intermittent printing, and "M5" indicates the conveying position corresponding to the unwinding start position at the time of starting the third image forming operation in the intermittent printing.

The solid line E3 in FIG. 11 indicates the surface potential of the long sheet at the time of performing the intermittent printing, and the broken line E4 indicates the surface potential of the long sheet at the time of performing the continuous printing. The solid line B3 indicates a transfer bias at the time of performing the intermittent printing, and a broken line B4 indicates a transfer bias at the time of performing the continuous printing.

As shown in FIG. 11, when the continuous printing is performed, the surface potential and the transfer bias gradually increase after the conveying position M1 as indicated by broken lines E4 and B4. The conveying position of the long sheet P, that is, the transfer bias depending on the diameter of the roll portion PP at the time of such continuous printing is previously stored in the storage unit 72. At the time of performing the intermittent printing, when printing is resumed after being stopped, the control unit 101 sets the transfer bias depending on the diameter of the roll portion PP at that time.

Specifically, after the conveying position M3, which is the unwinding start position when printing is stopped at the conveying position M2 and the printing is resumed as indicated by the solid lines E3 and B3, the transfer bias corresponding to the diameter of the roll portion PP after the conveying position M3 is set. Further, the transfer bias corresponding to the diameter of the roll portion PP after the conveying position M5 is set, after the conveying position M5, which is an unwinding start position when printing is stopped at the conveying position M4 and printing is resumed. This makes it possible to set the transfer bias suitable for the diameter of the roll portion PP.

Figure 12:
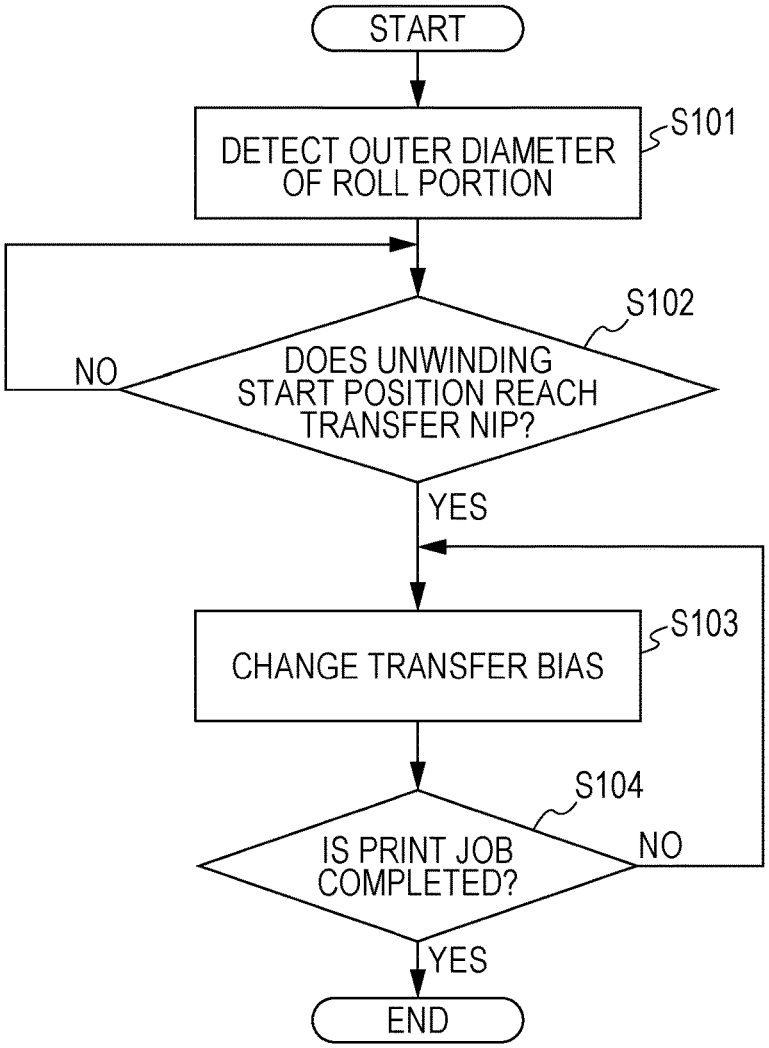
FIG. 12 is a flowchart showing an example of a transfer bias change control operation of the image forming apparatus according to an embodiment of the present invention.

Next, an example of transfer bias change control in the image forming apparatus 2 provided with the control unit 101 configured as described above will be described. FIG. 12 is a flowchart showing an example of the transfer bias change control of the image forming apparatus 2 according to the present embodiment. The process in FIG. 12 is executed when the control unit 101 receives an instruction to execute a print job.

As shown in FIG. 12, the outer diameter detecting unit 90 detects the outer diameter of the roll portion PP, and the control unit 101 acquires the detected outer diameter (step S101). Next, the control unit 101 determines whether the unwinding start position of the long sheet P has reached the transfer nip (step S102).

When the unwinding start position of the long sheet P has not reached the transfer nip as a result of the determination (step S102, NO), the control unit 101 repeats the determination of step S102. On the other hand, when the unwinding start position of the long sheet P has reached the transfer nip (step S102, YES), the control unit 101 changes the transfer bias (step S103).

Specifically, the control unit 101 changes the secondary transfer bias corresponding to the unwinding start position. Further, the control unit 101 changes the secondary transfer bias corresponding to the diameter of the roll portion PP at the unwinding position. Further, the control unit 101 determines whether the print job has ended (step S104).

If the print job has not ended as a result of the determination (step S104, NO), the control unit 101 returns to step S103 and continues the control of changing the transfer bias. On the other hand, when the print job has ended (step S104, YES), the control unit 101 ends this control.

As described in detail above, the image forming system 100 according to the present embodiment includes the image forming unit 40 which forms an image on the long sheet P unwound from the roll portion PP, and the control unit 101 which changes the image forming condition of the image forming unit 40 so that the image quality is uniform before and after the unwinding start position of the long sheet P.

According to the present embodiment thus configured, the image quality of the long sheet P unwound from the roll portion PP can be made uniform.

Further, because the amount of change in the transfer bias is determined depending on the diameter of the roll portion PP, it is possible to set a transfer bias suitable for the surface potential of the long sheet P.

The absolute value of the transfer bias increases as the diameter of the roll portion PP decreases. Accordingly, it is possible to set the transfer bias corresponding to the change in the surface potential of the long sheet P after the unwinding start position, and thus it is possible to suppress the occurrence of image failure after the unwinding start position.

Even if the surface potential of the long sheet P increases at the time of continuous printing, the transfer bias is changed to the one corresponding to the increase. Therefore, it is possible to suppress a decrease in the image density of the succeeding stage portion of the long sheet P compared with the preceding stage portion.

Further, even if the long sheet P is charged, a transfer bias suitable for the surface potential is applied. It is thus possible to suppress a failure in which the dot shape collapses in the halftone image. Therefore, it is possible to suppress the occurrence of image failure caused by the difference in image density on the long sheet P. Even if a minute image failure occurs, there is no difference in image density between the preceding stage portion and the succeeding stage portion of the long sheet P. It is thus possible to suppress occurrence of a large difference between the image of the preceding stage portion and the image of the succeeding stage portion.

In the aforementioned embodiment, the image formation on the long sheet P is started from the conveying position 0, but the present invention is not limited thereto. The control unit 101, for example, may perform control so as to start the image formation after the unwinding start position of the long sheet P.

Figure 13:
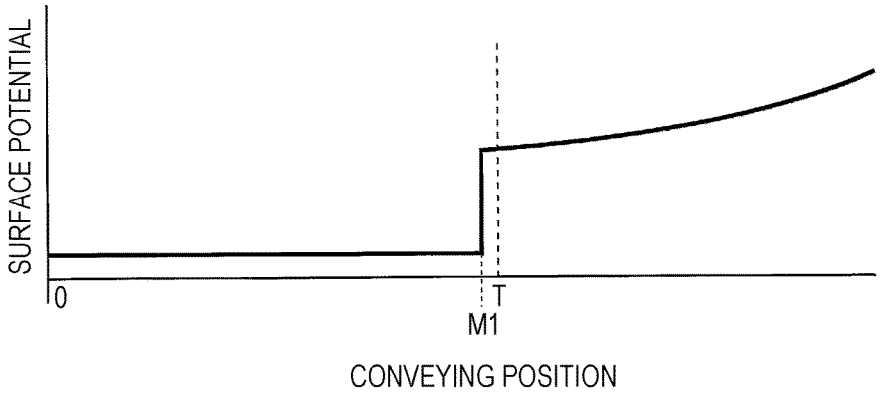
FIG. 13 is a diagram showing the surface potential of a long sheet with respect to the conveying position of the long sheet in Operation Example 1 in which an image formation start position is changed.

FIG. 13 is a diagram showing the surface potential of the long sheet with respect to the conveying position of the long sheet in the operation example of changing the image formation start position. "T" on the horizontal axis of FIG. 13 indicates the position at which printing of the long sheet is started.

As shown in FIG. 13, the control unit 101 controls the image forming unit 40 to start the image formation after the unwinding start position. Specifically, the control unit 101 starts the image formation at the position T, which is a portion on the rear side of the unwinding start position of the long sheet P.

Because the surface potential of the long sheet P suddenly fluctuates in the portion of the unwinding start position, when the image formation is performed across the unwinding start position, there is a possibility that a sudden image change occurs before and after the position. However, by performing such control, it is possible to suppress the occurrence of sudden image change before and after the unwinding start position.

Further, in the control of FIG. 13, the control unit 101 may determine whether to perform the image formation after the unwinding start position of the long sheet P based on information of the input image.

For example, in the case of a monochrome image (especially only characters or line images), because the influence on image quality is relatively small, a sudden image change hardly occurs before and after the unwinding start position. Therefore, when the image information is of a monochrome image, the control unit 101 performs the image formation from the position of "0" in FIG. 13. As a result, because the preceding stage portion of the unwinding start position is not wasted, it is possible to reduce the portion in which the long sheet P is wasted.

Figure 14:
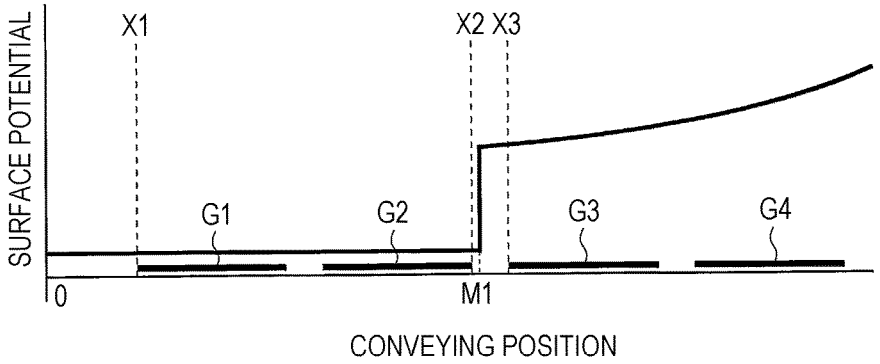
FIG. 14 is a diagram showing the surface potential of a long sheet with respect to the conveying position of the long sheet in Operation Example 2 in which the image formation start position is changed.

Further, the control unit 101 may determine the timing of image formation so that the unwinding start position of the long sheet P does not overlap the region of the image formed on the long sheet P based on the image information. FIG. 14 is a diagram showing the surface potential of the long sheet with respect to the conveying position of the long sheet in the operation example of changing the image formation start position.

Specifically, as shown in FIG. 14, if a plurality of image forming regions G1, G2, G3 and G4 is arranged at predetermined intervals, when the image formation is started from the position 0, the control unit 101 delays the timing of image formation such that the image forming region does not overlap the conveying position M1, that is, the unwinding start position in a case where a single image forming region overlaps the conveying position M1.

In FIG. 14, when starting the image formation from the conveying position 0, the image forming region G3 overlaps the conveying position M1. Therefore, the control unit 101 delays the timing of image formation such that the conveying position M1 is located between a leading end X3 of the image forming region G3 and a trailing end X2 of the preceding image forming region G2 from the image forming region G3. As a result, the timing of the image formation start is changed from the conveying position 0 to the conveying position X1. Therefore, it is possible to suppress the occurrence of sudden image change in the image forming region.

Figure 15:
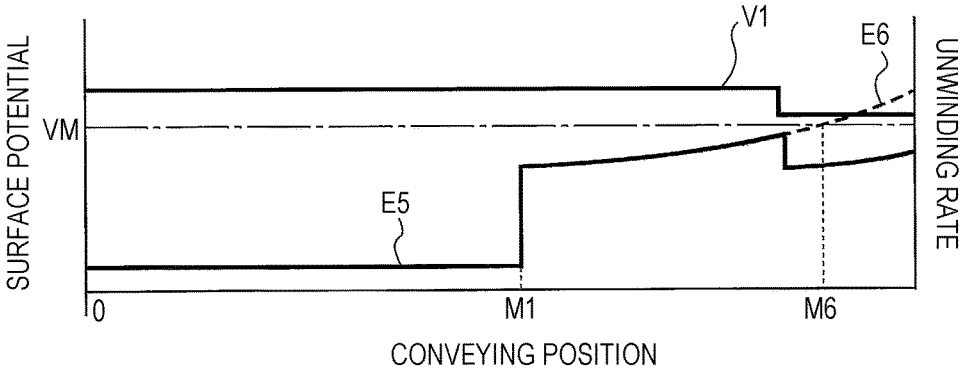
FIG. 15 is a diagram showing the surface potential and the unwinding rate of a long sheet with respect to the conveying position of the long sheet in the operation example of changing the unwinding rate.

Although the unwinding rate and the conveying rate of the long sheet P are not mentioned in the above embodiment, the unwinding rate and the conveying rate of the long sheet P may be controlled. FIG. 15 is a diagram showing the surface potential and the unwinding rate of the long sheet with respect to the conveying position of the long sheet in the operation example of changing the unwinding rate. A solid line E5 in FIG. 15 indicates the surface potential of the long sheet when the conveying rate control is performed, and a broken line E6 indicates the surface potential of the long sheet when the conveying rate control is not performed. Further, a solid line V1 shows a change in the unwinding rate of the long sheet.

As shown in FIG. 15, when the surface potential of the long sheet rises to a potential VM exceeding the range in which the amount of change in the transfer bias can change as indicated by the broken line E6, image failure occurs on the long sheet P after the position M6 corresponding to the potential VM.

In such a case, the control unit 101 performs the control of setting the unwinding rate of the long sheet P to be smaller than the unwinding rate of the case of determining that the amount of change in the transfer bias does not exceed the changeable range, that is, the unwinding rate of a case where the surface potential does not exceed the potential VM. In this way, the peeling rate of the long sheet P slows down, the charge amount due to peeling of the long sheet P from the roll portion PP decreases, and the surface potential decreases. As a result, since the surface potential of the long sheet P is in a range changeable by the change control of the transfer bias, it is possible to suppress the occurrence of image failure by such control.

Also, in this case, there is a possibility that a difference occurs between the unwinding rate of the long sheet P and the conveying rate of the long sheet P at the transfer nip. Thus, for example, when the buffer unit 91 is provided in the sheet feeder 1, the control unit 101 may stop the conveyance of the long sheet P in the transfer nip, cause the long sheet P to stay in the buffer unit 91 to some extent, and then convey the long sheet P toward the transfer nip. As a result, it is possible to absorb a difference which occurs between the unwinding rate and the conveying rate.

Further, when the surface potential exceeds the potential VM, the control unit 101 may reduce the conveying rate of the long sheet P at the transfer nip to a value lower than that of a case where the surface potential does not exceed the potential VM.

In this way, the surface potential can be lowered by discharging the long sheet P during conveyance of the long sheet P. Further, the control unit 101 may perform the control to reduce both of the unwinding rate and the conveying rate of the long sheet P.

Further, when performing the overprinting by the electrophotographic method, the long sheet P is charged by applying the transfer bias in the base printing. Therefore, the charge amount on the surface of the long sheet P at the time of overprinting becomes larger than that of the long sheet P at the time of normal printing not subjected to the overprinting. On the other hand, when overprinting is performed by methods other than the electrophotographic method, such as an inkjet method or an offset method, there is no charging provided by printing. Therefore, when the long sheet P is wound into a roll shape in the base printing, the adhesiveness between the sheets overlapping each other is reduced by the unevenness of ink or the like. Therefore, the charge amount on the surface due to peeling at the time of unwinding becomes smaller than that of the unused long sheet P which is not subjected to overprinting.

Figure 16:
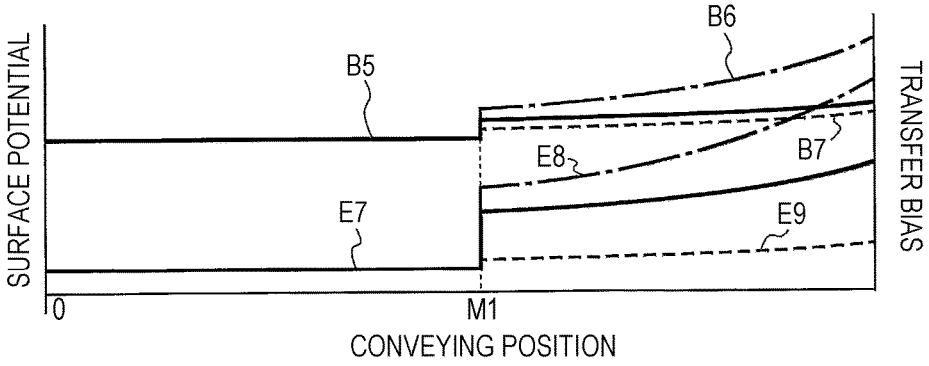
FIG. 16 is a diagram showing the surface potential and the transfer bias of the long sheet with respect to the conveying position of the long sheet in the case of normal printing and the case of overprinting.

Therefore, when overprinting is performed on the long sheet P, the control unit 101 may change the image forming condition, that is, the amount of change in the condition of the transfer bias, depending on the information of the image on the long sheet P subjected to base printing. In that case, the control unit 101 preferably changes the amount of change in the image forming condition in accordance with the printing method for the image printed on the long sheet P. FIG. 16 is a diagram showing the surface potential and the transfer bias of the long sheet with respect to the conveying position of the long sheet in the case of normal printing and in the case of overprinting.

A solid line E7 in FIG. 16 indicates the surface potential of the long sheet when performing the normal printing, an alternate long and short dashed line E8 indicates the surface potential of the long sheet when performing overprinting by the electrophotographic method, and a broken line E9 indicates the surface potential of the long sheet when performing overprinting by a method other than the electrophotographic method. A solid line B5 indicates a transfer bias when performing the normal printing, an alternate long and short dashed line B6 indicates a transfer bias when performing overprinting by the electrophotographic method, and a broken line B7 indicates a transfer bias in the case of performing overprinting by a method other than the electrophotographic method.

Specifically, as shown in FIG. 16, because the surface potential of the long sheet P is larger in the case of performing the overprinting by the electrophotographic method (see the alternate long and short dashed line E8) than in the case of performing the normal printing (see the solid line E7), the control unit 101 increases the amount of change in the transfer bias when the image printed on the long sheet P is an image printed by the electrophotographic method. In this way, the transfer bias (see the alternate long and short dashed line B6) when performing overprinting by the electrophotographic method becomes larger than the transfer bias (solid line B5) in the case of the normal printing.

Further, when overprinting is performed by a method other than the electrophotographic method (see a broken line E9), the surface potential of the long sheet P becomes smaller than in the case of normal printing. Accordingly, the control unit 101 decreases the amount of change in the transfer bias when the image printed on the long sheet P is an image printed by a method other than the electrophotographic method. By doing so, the transfer bias (broken line B7) in the case of performing the overprinting by the method other than the electrophotographic method becomes lower than the transfer bias in the case of the normal printing.

By performing control in this manner, it is possible to obtain a transfer bias corresponding to fluctuation of the charge amount of the long sheet P when overprinting is performed on the long sheet P.

Figure 17:
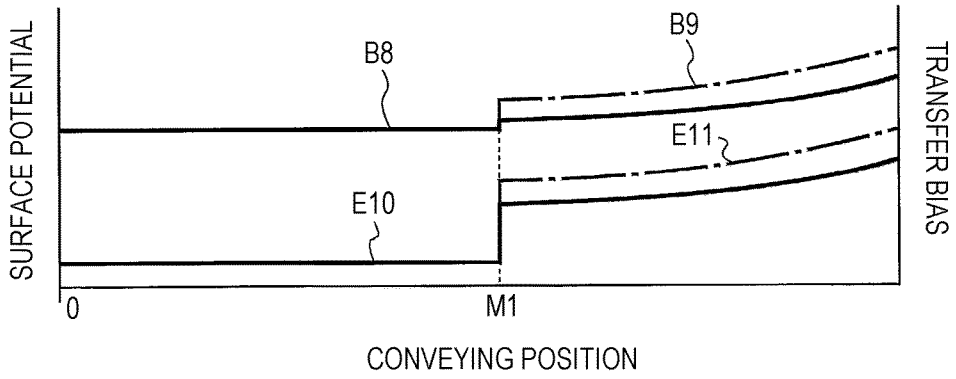
FIG. 17 is a diagram showing a surface potential and a transfer bias of a long sheet with respect to a conveying position of a long sheet in the case of different types of long sheet.

Although the type of long sheet is not mentioned in the aforementioned embodiment, the amount of change in transfer bias may be changed depending on the type of long sheet. FIG. 17 is a diagram showing the surface potential and the transfer bias of the long sheet with respect to the conveying position of the long sheet in the case of different types of long sheet. In FIG. 17, a solid line E10 indicates the surface potential in a case where the type of long sheet is paper, and an alternate long and short dashed line E11 indicates the surface potential in a case where the type of long sheet is PET. A solid line B8 indicates a transfer bias when the type of long sheet is paper, and an alternate long and short dashed line B9 indicates a transfer bias when the type of long sheet is PET.

Specifically, as shown in FIG. 17, when the surface potential (see the solid line E10) in a case where the type of long sheet is paper is compared with the surface potential (the alternate long and short dashed line E11) in a case where the type of long sheet is PET, the surface potential in a case where the type of long sheet is PET is larger. Therefore, the control unit 101 makes the transfer bias in a case where the type of long sheet is PET to be larger than in a case where the type of long sheet is paper. That is, the transfer bias (alternate long and short dashed line B9) in a case where the type of long sheet is PET is larger than the transfer bias (solid line B8) in a case where the type of long sheet is paper.

By performing control in this manner, it is possible to set the optimum transfer bias depending on the type of long sheet.

Although environmental conditions around the image forming apparatus 2 are not mentioned in the aforementioned embodiment, the control unit 101 may change the transfer bias depending on the environmental conditions around the image forming apparatus 2.

For example, when the environmental condition around the image forming apparatus 2 is low humidity, the amount of charge on the surface of the long sheet is likely to increase as compared with the case of normal humidity. Therefore, when the environmental condition around the image forming apparatus 2 is low humidity, the control unit 101 performs the control of increasing the transfer bias condition as compared with the case of normal humidity. By doing so, it is possible to set the optimum transfer bias depending on the environmental conditions around the image forming apparatus 2.

Figure 2:
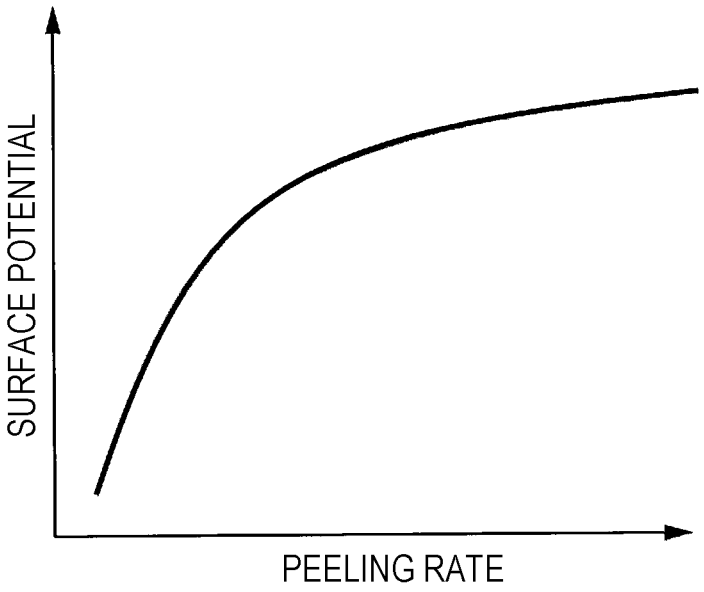
FIG. 2 is a diagram showing a change in surface potential of the long sheet with respect to a peeling rate at which the long sheet is peeled off from a roll portion.
Figure 18:
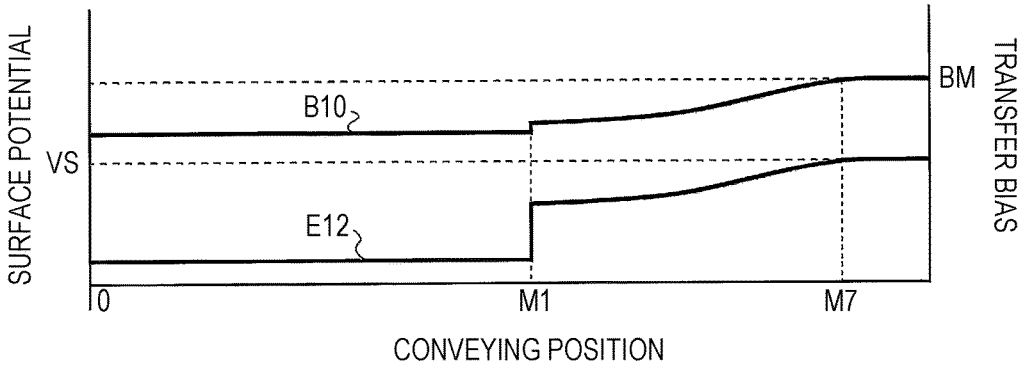
FIG. 18 is a diagram showing the surface potential and the transfer bias of the long sheet with respect to the conveying position of the long sheet when the surface potential reaches a saturation potential.

Further, the charge amount due to peeling becomes a saturated state when the peeling rate increases to a certain extent (see FIG. 2). Therefore, the control unit 101 may limit the amount of change in the transfer bias to a predetermined range. Specifically, when the surface potential of the long sheet P reaches the saturation potential, the control unit 101 sets the amount of change in the transfer bias in the long sheet P as the amount of change corresponding to the saturation potential. FIG. 18 is a diagram showing the surface potential and the transfer bias of the long sheet with respect to the conveying position of the long sheet when the surface potential reaches the saturation potential. In FIG. 18, a solid line E12 indicates the surface potential of the long sheet, and a solid line B10 indicates the transfer bias with respect to the conveying position of the long sheet.

As shown in FIG. 18, when the conveying position of the long sheet reaches M7, the surface potential becomes the saturation potential VS which is a saturation state. Therefore, when the conveying position of the long sheet reaches M7, the control unit 101 does not increase the amount of change in the transfer bias any more. That is, the transfer bias does not become larger than the upper limit value BM. Accordingly, it is possible to suppress the excessive correction of the transfer bias.

Although the transfer bias is exemplified as the image forming condition in the aforementioned embodiment, the present invention is not limited thereto. For example, when the surface of a long sheet is charged, because the size of the dot fluctuates, the image quality can be improved by changing the writing condition. Accordingly, this condition may be set as the image forming condition. Further, because the image density can be improved by adjusting the exposure conditions, the developing conditions, and the charge amount of the toner against the decrease in transfer efficiency caused by the charging of the long sheet, these conditions and the like may be set as the image forming conditions.

Figure 19A:
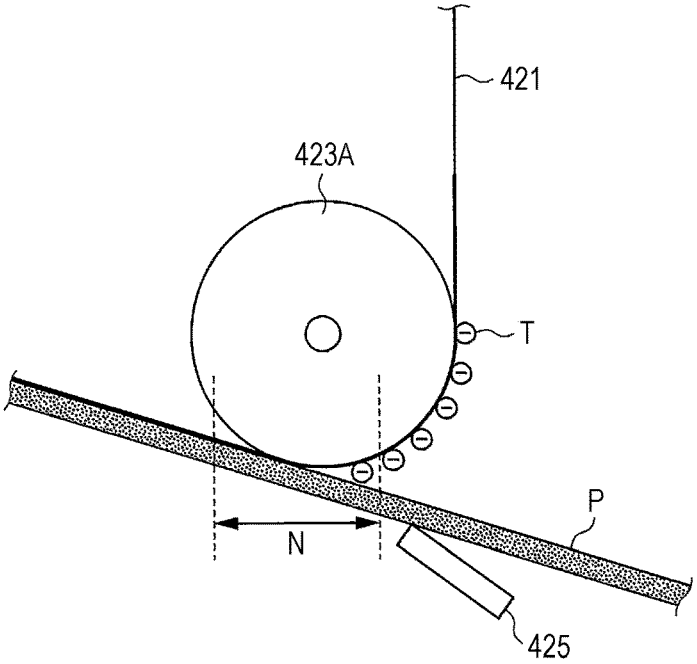
FIGS. 19A and 19B are enlarged views of the vicinity of a secondary transfer nip of the long sheet.
Figure 19B:
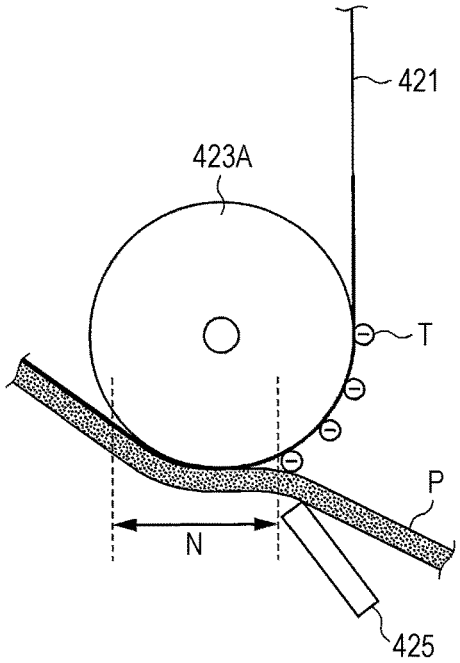

Further, as shown in FIGS. 19A and 19B, the control unit 101 may adjust the charged state of the long sheet P, by changing the position of the transfer guide 425 provided on the upstream side of the secondary transfer nip. FIG. 19A is an enlarged view of the vicinity of the secondary transfer nip N when there is no charge amount of the long sheet P, and FIG. 19B is an enlarged view of the vicinity of the secondary transfer nip N when the charge amount of the long sheet P is large.

The transfer guide 425 guides the long sheet P toward the secondary transfer nip N, by bringing the tip into contact with the back side of the long sheet P. The transfer guide 425 is capable of displacing the position in FIG. 19A and the position in FIG. 19B of moving the long sheet P upward, that is, closer to the intermediate transfer belt 421 than the position in FIG. 19A. By shifting the transfer guide 425 within the range from the position of FIG. 19A to the position of FIG. 19B, the trajectory of the long sheet P can be adjusted.

In the portion of the secondary transfer nip N, for example, a transfer electric field for moving the negatively charged toner T from the intermediate transfer belt 421 to the long sheet P is applied. Here, for example, when the long sheet P is charged to the negative polarity, at the upstream side of the transfer electric field, that is, at a place where the long sheet P is slightly away from the intermediate transfer belt 421, the surface potential of the toner T and that of the long sheet P repel each other unless the transfer electric field is increased. Thus, an expulsion is likely to occur, in which the toner T is transferred while being deviated from the desired position of the long sheet P.

Therefore, as shown in FIG. 19B, the control unit 101 performs the control of displacing the transfer guide 425 to bring the long sheet P closer to the intermediate transfer belt 421. Accordingly, even if the transfer electric field is slightly insufficient, as the distance between the long sheet P and the intermediate transfer belt 421 becomes shorter, the toner T is easily transferred to the long sheet P. Accordingly, it is possible to transfer the toner T to the long sheet P while suppressing the occurrence of expulsion.

Further, the long sheet P may be discharged according to the surface potential of the long sheet P. For example, by providing a discharging member including a brush having conductive fibers on the upstream side of the secondary transfer nip, and by bringing the discharging member into contact with the surface of the long sheet to apply a predetermined bias, the long sheet can be discharged. Also, the long sheet may be discharged with an ionizer or the like.

Although a plurality of conditions is provided as the aforementioned image forming conditions, from the viewpoint of ease of control, it is desirable to set the transfer bias as the image forming condition.

Although the present invention has been described and illustrated in detail, it is clearly understood that the same is by way of illustrated and example only and is not to be taken by way of limitation, the scope of the present invention being interpreted by terms of the appended claims. That is, the present invention can be implemented in various forms, without departing from the gist or the main features thereof.

What is claimed is:

1. An image forming apparatus comprising:

an image forming unit configured to form an image on a recording medium which is unwound from a state of being wound in a roll shape; and a control unit configured to correct for variations in a surface potential of the recording medium caused by unwinding the recording medium from the roll shape by changing an image forming condition of the image forming unit such that image quality becomes uniform before and after an unwinding start position of the recording medium at the time of start of an image forming operation.

2. The image forming apparatus according to claim 1, wherein the control unit changes an amount of change in the image forming condition depending on an outer diameter of a portion of the recording medium wound in a roll shape.

3. The image forming apparatus according to claim 1, wherein the image forming unit includes a transfer unit configured to transfer an image onto the recording medium, and the image forming condition is a transfer bias for transferring the image onto the recording medium in the transfer unit.

4. The image forming apparatus according to claim 3, wherein the control unit increases an absolute value of the transfer bias as an outer diameter of a portion of the recording medium wound in a roll shape decreases.

5. The image forming apparatus according to claim 1, wherein the control unit starts image formation after the unwinding start position of the recording medium.

6. The image forming apparatus according to claim 5, wherein the control unit determines whether to start the image formation after the unwinding start position of the recording medium based on information of the image.

7. The image forming apparatus according to claim 1, wherein the control unit determines timing of the image formation such that the unwinding start position of the recording medium does not overlap a region of an image formed on the recording medium.

8. The image forming apparatus according to claim 1, wherein the control unit determines whether an amount of change in the image forming condition exceeds a changeable range, and when determining that the amount of change in the image forming condition exceeds the changeable range, the control unit sets an unwinding rate of the recording medium to be smaller than in a case of determining that the amount of change in the image forming condition does not exceed the changeable range.

9. The image forming apparatus according to claim 8, further comprising:

a buffer unit configured to retain the recording medium unwound to an upstream side in a conveying direction of the recording medium from the image forming unit, wherein, when reducing the unwinding rate of the recording medium, the control unit retains the recording medium in the buffer unit and then conveys the recording medium toward the image forming unit.

10. The image forming apparatus according to claim 1, wherein the control unit determines whether an amount of change in the image forming condition exceeds a changeable range, and when determining that the amount of change in the image forming condition exceeds the changeable range, the control unit sets a conveying rate of the recording medium in the image forming unit to be smaller than in a case of determining that the amount of change in the image forming condition does not exceed the changeable range.

11. The image forming apparatus according to claim 1, wherein, when performing overprinting on the recording medium, the control unit changes the amount of change in the image forming condition depending on information of the image base-printed on the recording medium.

12. The image forming apparatus according to claim 11, wherein, when a printing method of the image base-printed on the recording medium is an electrophotographic method, the control unit sets the amount of change in the image forming condition to be larger than in a case where the overprinting is not performed.

13. The image forming apparatus according to claim 11, wherein, when the printing method of the image base-printed on the recording medium is not an electrophotographic method, the control unit sets the amount of change in the image forming condition to be smaller than in a case where the overprinting is not performed.

14. The image forming apparatus according to claim 1, wherein the control unit changes an amount of change in the image forming condition depending on the type of the recording medium.

15. The image forming apparatus according to claim 1, wherein the control unit changes an amount of change in the image forming condition depending on an environmental condition around the image forming apparatus.

16. The image forming apparatus according to claim 1, wherein the control unit limits an amount of change in the image forming condition to a predetermined range.

17. An image forming system including a plurality of units including an image forming apparatus, the image forming system comprising:

an image forming unit configured to form an image on a recording medium which is unwound from a state of being wound in a roll shape; and a control unit configured to correct for variations in a surface potential of the recording medium caused by unwinding the recording medium from the roll shape by changing an image forming condition of the image forming unit such that image quality becomes uniform before and after an unwinding start position of the recording medium at the time of start of an image forming operation.

18. An image forming condition controlling method, comprising:

correcting for variations in a surface potential of a recording medium caused by unwinding the recording medium from a roll shape by changing an image forming condition which is set for forming an image such that image quality becomes uniform before and after an unwinding start position of a recording medium at the time of start of an image forming operation, when forming the image on the recording medium which is unwound from a state of being wound in the roll shape.

* * * * *